US007854350B2

(12) United States Patent
Lasserre et al.

(10) Patent No.: US 7,854,350 B2
(45) Date of Patent: Dec. 21, 2010

(54) DISTRIBUTION ASSEMBLY INTENDED FOR CONTEMPORANEOUS DISTRIBUTION OF TWO PRODUCTS

(75) Inventors: Pierre-Andre Lasserre, Coubron (FR); Marcel Sanchez, Paris (FR)

(73) Assignee: L'Oreal, Paris (FR)

( * ) Notice: Subject to any disclaimer, the term of this patent is extended or adjusted under 35 U.S.C. 154(b) by 1324 days.

(21) Appl. No.: 11/239,327

(22) Filed: Sep. 30, 2005

(65) Prior Publication Data

US 2006/0065674 A1 Mar. 30, 2006

Related U.S. Application Data

(60) Provisional application No. 60/617,069, filed on Oct. 12, 2004.

(30) Foreign Application Priority Data

Sep. 30, 2004 (FR) ..... 04 52206

(51) Int. Cl.
*B67D 7/70* (2010.01)

(52) U.S. Cl. ..... 222/137; 222/402.12; 222/380; 222/135; 222/402.23; 222/145.5; 222/469; 222/153.14

(58) Field of Classification Search ..... 222/402.21, 222/402.22, 402.23, 153.12, 153.13, 145.4, 222/145.5, 469, 472, 473, 135, 136, 137, 222/153.11

See application file for complete search history.

(56) References Cited

U.S. PATENT DOCUMENTS 3,236,457 A 2/1966 Kennedy et al.
3,506,159 A * 4/1970 Muller ..... 222/135
3,559,890 A * 2/1971 Brooks et al. ..... 239/304
3,635,372 A * 1/1972 Van Dyck et al. ..... 222/3
6,305,578 B1 * 10/2001 Hildebrandt et al. ..... 222/135
6,308,863 B1 * 10/2001 Harman ..... 222/135

(Continued)

FOREIGN PATENT DOCUMENTS

CA 2029332 5/1991

(Continued)

*Primary Examiner*—Kevin P Shaver
*Assistant Examiner*—Melvin A Cartagena
(74) *Attorney, Agent, or Firm*—Oblon, Spivak, McClelland, Maier & Neustadt, L.L.P.

(57) ABSTRACT

A distribution assembly includes at least two containers or receptacles, each containing a product, and being fitted with a valve having an actuator rod. A distribution device is mounted on top of the containers and includes a distribution nozzle fitted with at least one distribution orifice. The distribution device further includes a movable actuator element to provoke the simultaneous distribution of two products in a mixed or separate state. Further, an intermediate body is separate from the actuator element and includes two skirts. The intermediate body is able to engage respectively on the two actuator rods of the containers, and at least one inner channel allows the flow of products towards the distribution nozzle. The actuator element and the intermediate body are arranged to co-operate on operation of the actuator element so as to allow the passage of products from the recipients to the distribution nozzle via the inner channel. The actuator rods can be actuated by tilting in the disclosed example, and the actuator element is designed to tilt the intermediate body so as to cause the actuator rods to tilt.

40 Claims, 5 Drawing Sheets

U.S. PATENT DOCUMENTS

| | | | | |
|---|---|---|---|---|
| 6,382,463 | B2 * | 5/2002 | Meshberg | 222/1 |
| 6,722,532 | B2 * | 4/2004 | Lasserre et al. | 222/137 |
| 2002/0117516 | A1 | 8/2002 | Lasserre et al. | |
| 2003/0071085 | A1 | 4/2003 | Lasserre et al. | |

FOREIGN PATENT DOCUMENTS

| | | |
|---|---|---|
| EP | 0243667 | 11/1987 |
| EP | 0313414 | 4/1989 |
| EP | 0427609 | 5/1991 |
| FR | 1413164 | 8/1965 |
| FR | 2598392 | 11/1987 |
| FR | 2732245 | 10/1996 |
| FR | 2815616 | 4/2002 |
| GB | 1163978 | 9/1969 |
| JP | 1-63685 | 4/1989 |
| JP | H04-53960 | 5/1992 |
| JP | 7-15584 | 3/1995 |
| JP | 07262517 | 9/1995 |
| JP | H11-59746 | 3/1999 |
| JP | 2002-369712 | 12/2002 |
| JP | 2003-40365 | 2/2003 |
| JP | 2003-305391 | 10/2003 |

* cited by examiner

DISTRIBUTION ASSEMBLY INTENDED FOR CONTEMPORANEOUS DISTRIBUTION OF TWO PRODUCTS

CROSS-REFERENCE TO RELATED APPLICATIONS

This document claims priority to French Application Number 04 52206, filed Sep. 30, 2004 and U.S. Provisional Application No. 60/617,069, filed Oct. 12, 2004, the entire content of which are hereby incorporated by reference.

FIELD OF THE INVENTION

The invention concerns the distribution of two products to be dispensed contemporaneously, with the products separate or mixed. The invention can be particularly advantageous for distributing two hair colorant products, but can also be used for other products.

BACKGROUND OF THE INVENTION

Discussion of Background

Numerous devices are known allowing the contemporaneous mixing of two products stored separately. For example, French patent application FR-A-2 732 245 discloses a distribution assembly that includes a body and a push-button which is movable relative to the body to provide simultaneous and separate distribution of two products from two receptacles in which the products are stored separately. Each receptacle is fitted with a valve having a hollow actuator rod, the pressing of which causes distribution of the product.

One difficulty with certain known distribution assemblies arises from the fact that the actuator rods can have upper ends which are not located at precisely the same level taking into account production tolerances, which causes a risk of non-simultaneous distribution of the products.

Other distribution assemblies have been proposed but do not however offer complete satisfaction. For example, reference is made to U.S. Pat. No. 3,236,457, European patent applications EP-A-0 313 414, EP-A 0 427 609 or EP-A 0 243 667, British patent GB 1,163,978 or French patent applications FR-A-2 598 392 and FR-A-1 413 164.

Patent application FR 2815616 also describes a distribution assembly of this type in which the actuator rods are pressed in response to the operation of a single actuator element. However an actuator element in the form of a lever arm is necessary to press down two actuator rods without too much difficulty.

There is a need for a distribution assembly which can distribute the same quantity of product from each receptacle or container.

There is also a need for a distribution assembly which can be activated easily.

There is also a need for an assembly which limits the accidental distribution of the products.

There is also a need for an assembly which minimizes the oxidation of the products to be distributed.

SUMMARY OF THE INVENTION

According to an example of the invention, a distribution assembly is provided which includes at least two containers or receptacles, each containing a product, and each being fitted with a valve having an actuator rod. A distribution device is mounted on top of the containers and includes a distribution nozzle fitted with at least one distribution orifice. In addition, a movable actuator element is provided to provoke the simultaneous distribution of two products in the mixed or separate state. Further, an intermediate body is separate from the actuator element and includes two skirts able to engage respectively on the two actuator rods of the containers, and at least one inner channel allowing the flow of products towards the distribution nozzle. The actuator element and the intermediate body are arranged to co-operate on operation of the actuator element so as to allow the passage of products from the containers to the distribution nozzle via the inner channel. The actuator rods can be actuated by tilting and the actuator element can be designed to tilt the intermediate body so as to cause the actuator rods to tilt.

As the actuator rods can be actuated by tilting in this example, they require a low support force in order to be actuated, which allows ease of use. The assembly can allow the product to emerge from the actuator rods upon a small amount of tilting.

By way of example, the actuator element can include at least two tabs, preferably rigid, and able to come to rest on the intermediate body in at least two support zones spaced apart in order to cause the intermediate body to tilt. By using two separate support zones, the simultaneous activation or more nearly simultaneous of both actuator rods of the two containers can more easily be guaranteed. Thus the same quantity of product from each container can be distributed.

The distance between the one support zone and the one skirt can be approximately the same as the distance between the other support zone and the other skirt. Again the simultaneous activation of both actuator rods can be thereby better assured. Preferably support zones in the axes of the actuator rods are used.

Each tab can include an inclined edge intended to come to rest on the intermediate body.

The distribution nozzle and the intermediate element can be arranged such that the tilting of the intermediate element causes the tilting of the distribution nozzle on operation of the actuator element.

The intermediate body can include an outlet pipe via which the products emerge in a separate or a mixed state, where the distribution nozzle can include a mouthpiece able to receive this outlet pipe. The intermediate body can be arranged to transfer the products separately to the distribution nozzle or alternatively to allow the mixing of the products before they reach the distribution nozzle.

Also by way of example, the distribution nozzle can be arranged to transfer the products separately to its free end which delimits two distribution orifices. The distribution device can include an assembly collar which can engage on collars formed on the receptacles.

The distribution nozzle can be linked by a flexible strap to an assembly skirt which can engage on the assembly collar, for example.

In addition, by way of example, the distribution device can include a cap intended to protect the distribution nozzle. The free end of the nozzle can move away from the cap on operation of the actuator element. The cap can have a flap able to close the free end of the distribution nozzle. The flap may also be configured to prevent or restrict, when closed, movement of the actuator element sufficient to provoke distribution of the products. To this end, the flap can include a projecting element which can be inserted so that it is able to rest in the pipe of the distribution nozzle so as to limit or even prevent movement of the nozzle in relation to the cap.

The assembly collar can include tubular skirts defining housings intended to receive the containers or receptacles.

The containers can contain products for contemporaneous mixing.

The containers contain cosmetic products in a preferred example, in particular colorants. The products may take the form of a foam or cream.

The containers can also be pressurized.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the detailed description below of non-limitative embodiment examples of the invention, and from the attached drawings in which.

DETAILED DESCRIPTION OF THE PREFERRED EMBODIMENTS

Figure 1:
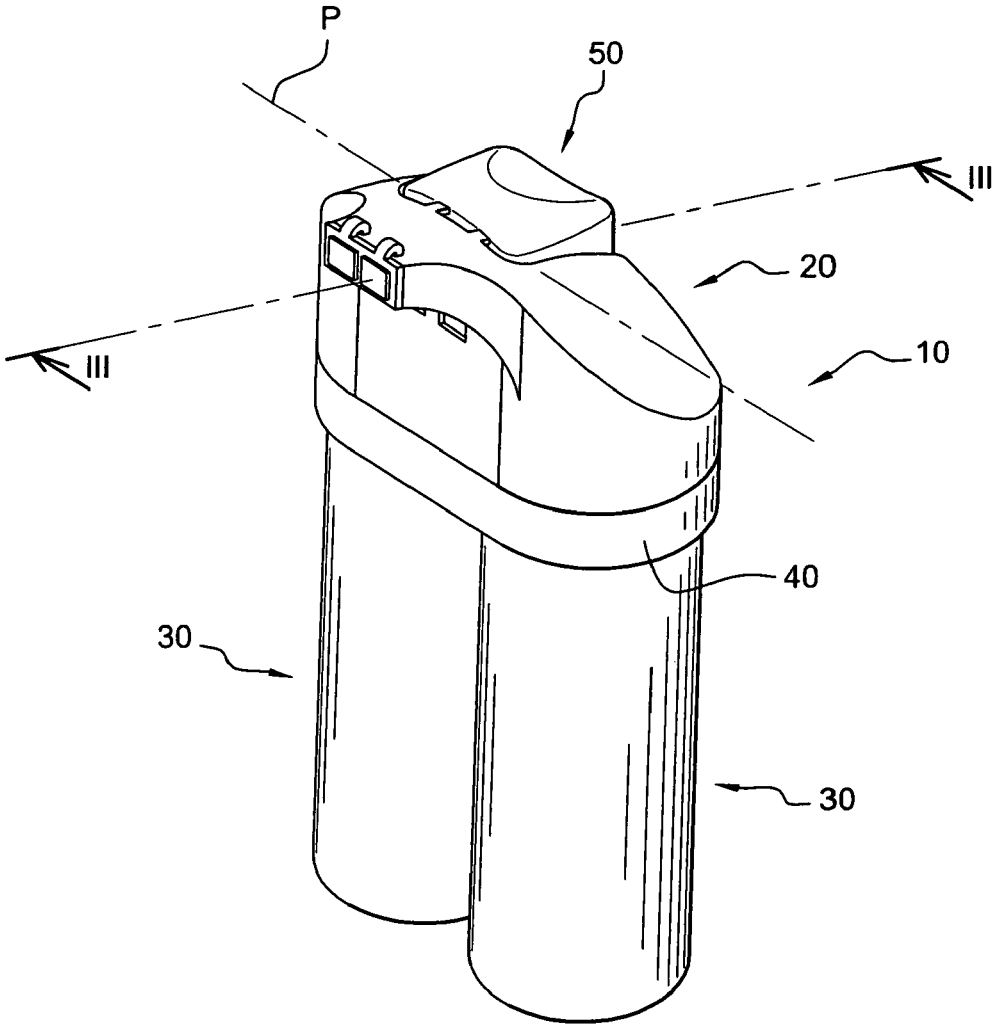
FIG. 1 is a diagrammatic view in perspective of a distribution assembly fitted with a distribution device in accordance with a first embodiment of the invention.

The example of FIG. 1 shows a distribution assembly 10 which includes a distribution device 20 mounted on two containers 30 containing products to be mixed contemporaneously.

As will be seen more particularly in FIG. 2, the distribution device 20 includes an assembly collar 40 which joins or couples together the two containers 30, an actuator element 50, a distribution nozzle 60 and an intermediate body 70, the role of which will be explained below. By way of example, each of these elements of the distribution device may be produced by moulding, for example, a thermoplastic material such as polypropylene.

Figure 2:
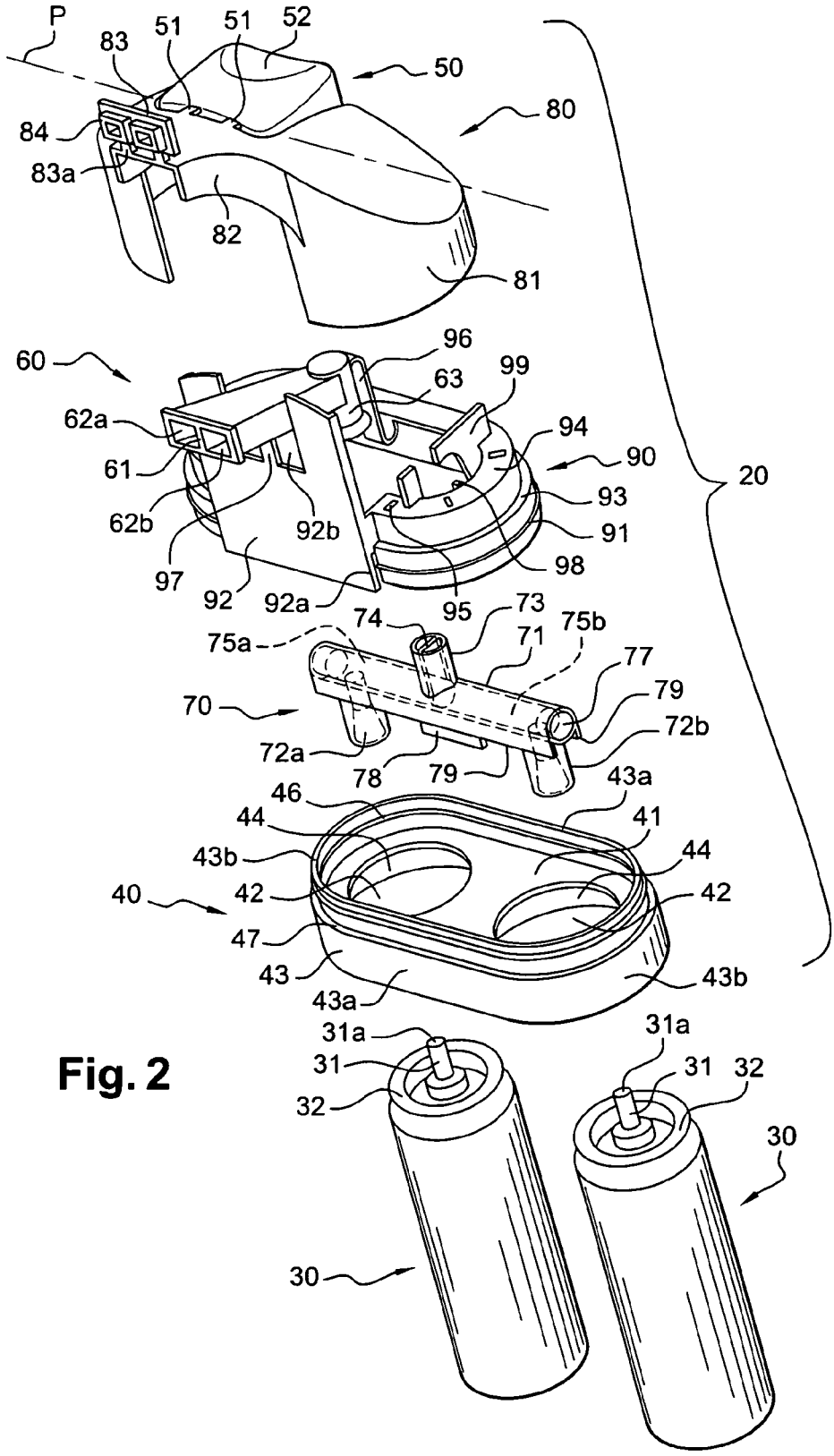
FIG. 2 shows an exploded view of the assembly shown in FIG. 1.

Each container 30 in the embodiment example described is of the pressurized aerosol type and includes a valve fitted with an actuator rod 31 as can be seen in FIG. 2. The valve is held by clamping on a collar 32 of the container in the example illustrated.

The actuator rod 31 is hollow and the product is distributed through this when the actuator rod is tilted.

The assembly collar 40 is provided to hold together the two containers. The collar can join or couple the containers upon supply of the various parts on the assembly line. The assembly collar 40 in the illustrated example includes a flat wall 41 through which pass two circular openings 42 each intended to receive an upper end of one of the containers 30.

The flat wall 41 is surrounded at its periphery by a cover wall 43 which extends on either side of this flat wall 41 in a perpendicular fashion. The cover wall 43 includes two parallel straight portions 43*a* which are linked together by two arc-shaped portions 43*b*. Each of the two arc-shaped portions 43*b* is extended, under the flat wall 41, by a complementary arc-shaped portion so as to form two tubular skirts 44. Each tubular skirt 44 includes a transverse circular section and surrounds one of the circular openings 42. Each tubular skirt 44 includes, on its radially inner surface, an annular flange 45 visible in FIG. 5 and able to engage on the collar 32 of the corresponding container so as to fix the collar to each container. Each tubular skirt 44 terminates in a bevelled end 44*a* for ease of assembly on the containers.

A flange 46 is provided on the inner surface of the part of the cover wall 43 located above the flat wall 41 to allow engagement of the distribution nozzle 60.

A radial recess 47 is formed on the radially outer surface of the cover wall 43, the function of which will be explained below.

To distribute the product relatively precisely, the device 20 includes a distribution nozzle 60 which, once the device is mounted on the containers, allows product output in a direction approximately perpendicular to the main axis of the containers via two distribution orifices 62*a* and 62*b*.

Figure 3:
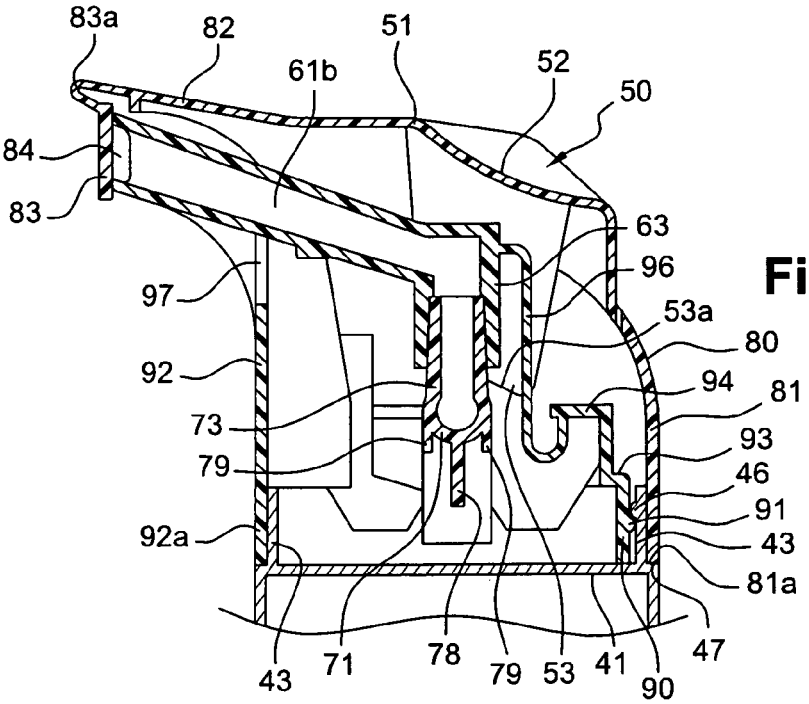
FIG. 3 is a partial section along line III-III of FIG. 1.

The distribution nozzle 60 is elongated in form and extends along a main axis which is inclined towards the top of the device when placed on the containers and the actuator element is at rest, as can be seen in FIG. 3. In an illustrated example, the nozzle includes a transverse section in relation to its main axis which is of rectangular shape and expands towards its free end which delimits the distribution orifices such that the nozzle flares out in the direction of the distribution orifices.

The distribution nozzle 60 is arranged to transfer the products separately to its free end. To this end, the nozzle 60 includes a partition 61 which delimits the two pipes 61*a* and 61*b* opening via the two distribution orifices 62*a* and 62*b* so as to allow distribution of the two products separately. The two orifices 62*a* and 62*b* are square in form.

Opposite these orifices, the nozzle 60 extends via a mouthpiece 63 running parallel to the main axis of the valve rods. The mouthpiece 63 has a section transverse to its main circular axis. The mouthpiece 63 is also divided into two compartments on its upper part by the partition 61 which extends to the upper part of the mouthpiece 63.

The mouthpiece 63 is provided to slide over an outlet pipe of the intermediate element which, as will be seen in detail below, is an intermediate part allowing the nozzle 60 to communicate with the containers.

The distribution nozzle 60 is held on the assembly collar by an assembly skirt 90 intended to be inserted in the upper part of the cover wall 43 of the assembly collar, in its interior. The assembly skirt 90 includes a flange 91 on its outer surface which co-operates with the flange 46 provided on the cover wall 36 of the assembly collar.

Like the cover wall 43, the assembly skirt 90 includes two straight parallel walls which are linked together by two arc-shaped portions. One of the two straight walls is offset toward the outside of the skirt and extends above the rest of the skirt by a front wall 92 which, as will be seen below, extends an outer cap or provides an extension of an outer cap. In particular, the lower part 92*a* of the front wall 92 is intended to come to slide outside the cover wall 43 of the assembly collar, in contrast to the rest of the assembly skirt 90.

This front wall 92 includes, on its upper part, a curved edge recess 92*b* which allows passage of the distribution nozzle 60.

The assembly skirt 90 also includes a radial recess 93, such that its upper part is set back from its lower part. The upper part of the assembly skirt 90 extends radially inwards via a wall 94 transverse to the skirt. This wall 94 includes slots 95, the function of which will be explained below.

The distribution nozzle 60 is linked to the assembly skirt 90 by a flexible S-shaped strap 96 which extends between the assembly skirt 90 and the mouthpiece 63 opposite the distribution orifices. This flexible strap 96 allows movement of the nozzle 60 in relation to the assembly skirt 90.

Figure 4:
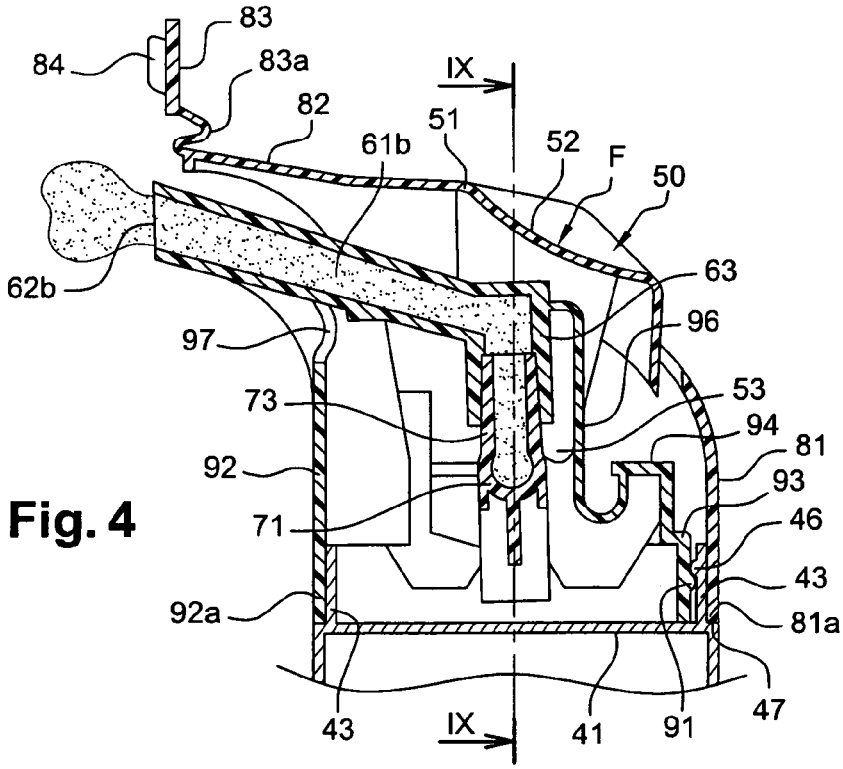
FIG. 4 is a partial section of the device according to the invention during activation.

To prevent or reduce the distribution nozzle 60 from wobbling when assembled on the containers, advantageously a tab 97 is provided which links the nozzle 60 to the front wall 92 just below the nozzle. The tab 97 must be sufficiently rigid to avoid excessive movement of the nozzle in relation to the assembly skirt 90 but sufficiently flexible to allow the tilting of the nozzle on operation of the actuator element. The tab may in fact bend, as is shown in FIG. 4, to allow the nozzle 60 to tilt forwards.

Figure 8:
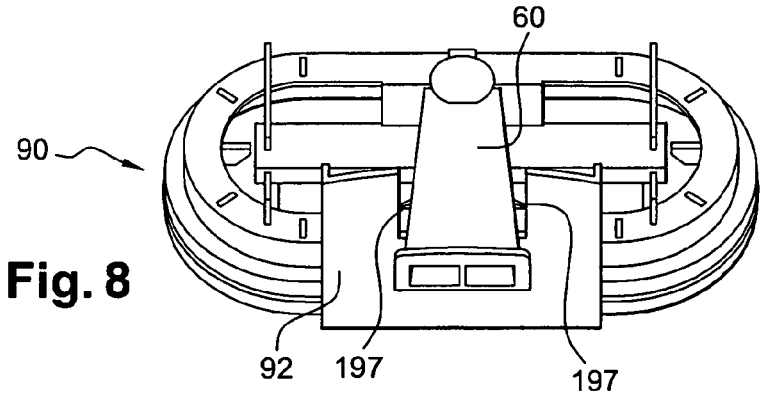
FIG. 8 represents a variant form of the nozzle of the distribution device.

By way of a further example, instead of using a tab 97 to prevent the nozzle 60 wobbling during assembly, as a variant two pins 197 may be provided on either side of the nozzle 60, each pin 197 linking the nozzle 60 to the front wall 92 as shown in FIG. 8. These pins are sufficient to hold the nozzle in a fixed position in relation to the assembly skirt 90 but are able to break at the first activation of the actuator element to allow tilting of the nozzle relative to the front wall 92.

At each rounded end of the assembly skirt 90, inside the skirt, walls forming a stop are provided to facilitate positioning of the intermediate element 70 in relation to the distribution nozzle. In particular, a stop 98 is provided at each rounded end and two other walls 99, perpendicular to these first stops 98, are also provided close to each rounded end of the assembly skirt.

To allow the flow of product from each recipient to the distribution nozzle, an intermediate body 70 is used that is intended to allow the actuator rods 31 of the containers 30 to communicate with the distribution nozzle 60.

Figure 5:
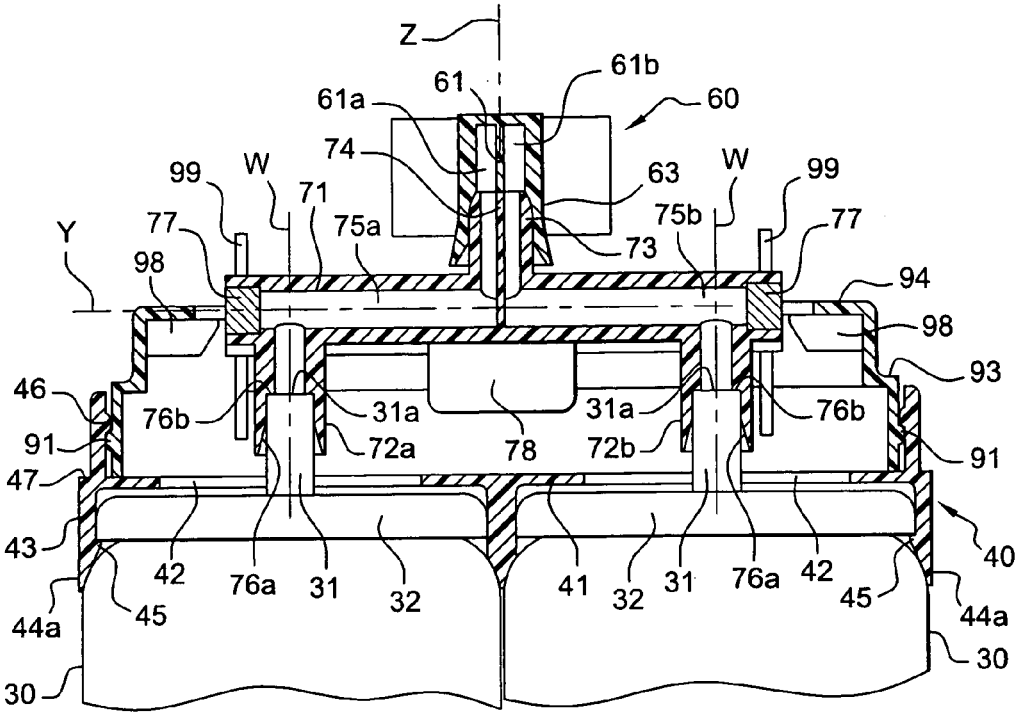
FIG. 5 represents a section through the distribution assembly in FIG. 1 in a plane containing the axes of the actuator rods, where the cap is not shown.
Figure 6:
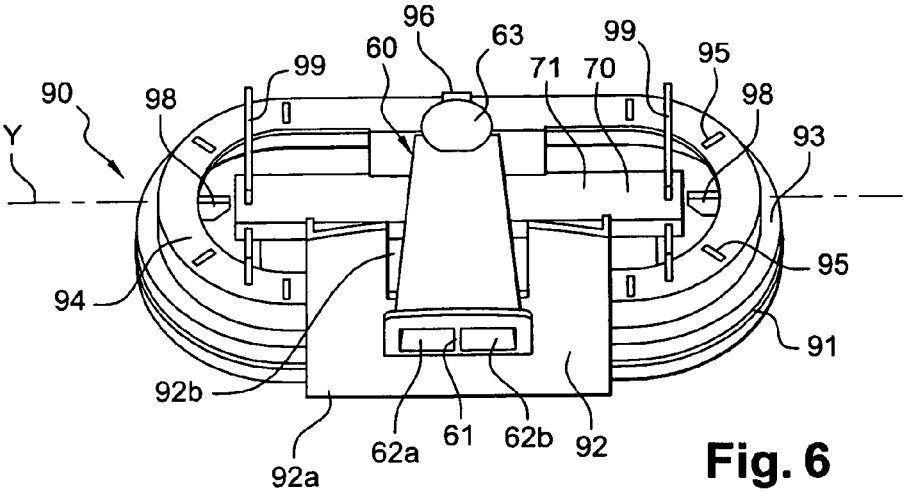
FIG. 6 shows a perspective view of the distribution nozzle and the intermediate body.

The intermediate body 70, as will be seen more particularly in FIGS. 5 and 6, includes a tubular part 71 or tubular section elongated along an axis Y and open at its two ends. In addition, two skirts or passages 72*a* and 72*b* are provided having axis W perpendicular to axis Y, with each skirt communicating with the inside of the elongated part 71. Further, an outlet pipe 73 is provided having a main axis Z perpendicular to axis Y and located in a median plane equidistant from skirts 72*a* and 72*b*.

A partition 74 divides the outlet pipe 73 into two compartments and extends into the tubular part 71 to divide this into two, so as to form two inner channels 75*a* and 75*b* allowing the separate flow of the two products.

Each skirt 72*a* and 72*b* has a first portion 76*a* with an inner surface which is conical for ease of application to the actuator rod 31 of the corresponding recipient. The first portion 76*a* is connected by a straight portion, in which can slide tightly the actuator rod 31, to a shoulder 76*b* against which comes to rest the upper end 31*a* of the actuator rod.

The elongated tubular part 71 of the intermediate body 70 is closed at its ends via a nozzle 77, the outlet opening of which is plugged as can be seen from FIG. 5. Naturally any other plug could be used to close these ends.

The intermediate body 70 includes on the lower part, on the same side as skirts 72*a* and 72*b*, a central stiffening rib 78, the ends of which are spaced from skirts 72*a* and 72*b*, and two longitudinal ribs 79 each extending over the entire length of the intermediate body 70.

When the intermediate body 70 is placed in the device, skirts 72*a* and 72*b* come into position at the center of the respective assembly skirts 44 of the assembly collar.

To protect the distribution nozzle 60, an external cap 80 covers the distribution nozzle and intermediate element. In the illustrated example, the cap 80 includes a shell 81, the lower part of which comes to surround the upper part of the cover skirt 43 of the assembly collar, and the edge 81*a* of which comes to rest against the radial recess 47 of the cover skirt of the collar.

The shell 81 is open in its upper part so as to house the actuator element 50.

The shell 81 is also open on its front part to allow opening of the product outlet orifices 62*a* and 62*b*, with this open part being partly closed by the front wall 92 provided on the assembly skirt 90 of the nozzle. Only an opening corresponding to the free end of the distribution nozzle is provided in the illustrated example.

Above the front opening, the cap terminates in a projection 82 which follows the form of the free end of the distribution nozzle 50 when the actuator element is at rest.

A flap 83 is provided above this projection 82 to be able to close the distribution orifices 62*a* and 62*b* and prevent impurities from entering the distribution nozzle. The flap 83 is hinged on the cap via a film hinge 83*a*, in particular a spring-effect hinge.

Advantageously the flap 83 comprises on its surface facing the distribution orifices in closed position, two projecting elements 84 of square form in the illustrated example. These projecting elements 84 come to rest in the ends of the pipes 61*a* and 61*b* of the distribution nozzle such that when the flap 83 is in the closed position, the projecting elements 84 prevent the distribution nozzle from moving relative to the flap and hence also relative to the rest of the cap. The flap 83 thus prevents the movement of the intermediate body 70 and hence that of the actuator element 50. This prevents accidental activation of the actuator element, which could cause distribution of the products.

Figure 7:
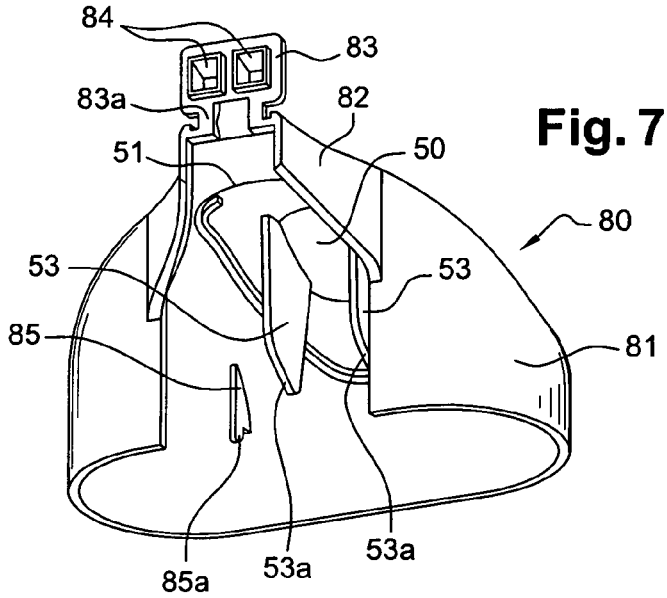
FIG. 7 shows a perspective view of the cap and actuator element.

To allow the fixing of the cap 80 on the remainder of the device, vertical ribs 85 partly visible in FIG. 7 are provided on the inner surface of the shell. The ribs 85 comprise an end 85*a* which comes to rest in each of the slots 95 of the assembly skirt of the distribution nozzle.

The cap is made of one piece with the actuator element 50 as can be seen in FIG. 1 or 2. In particular, the actuator element 50 is linked to the cap by two film hinges 51 which allow the actuator element to tilt around an axis P. The actuator element 50 includes a support surface 52 on which the user can rest to cause the actuator element 50 to pivot about axis P.

Figure 9:
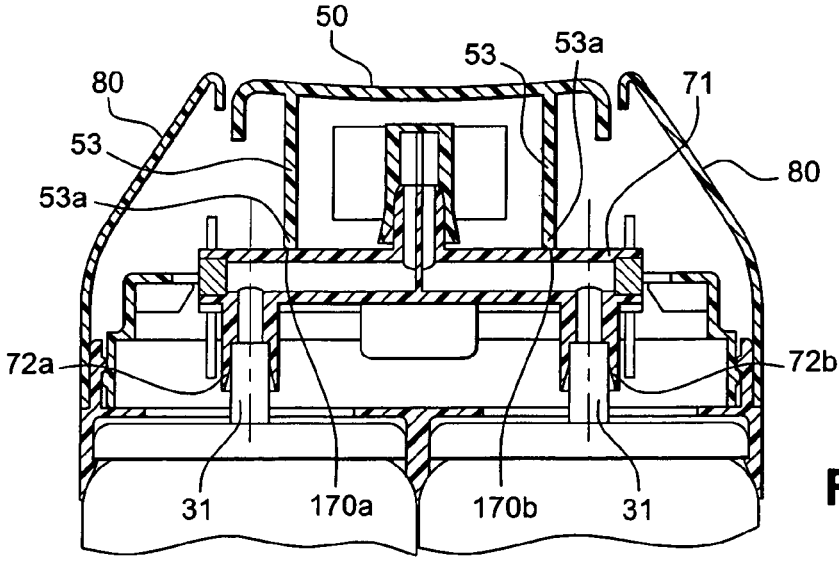
FIG. 9 represents a section along line IX-IX of FIG. 4.

As can be seen more particularly in FIGS. 7 and 9, the actuator element 50 includes on its inner side two rigid tabs 53 spaced apart and intended to come to rest on the elongated tubular section 71 of the intermediate body 70 in two support zones 170*a* and 170*b*. The forces are thus distributed evenly over the intermediate body. Each tab 53 includes an inclined edge 53*a* which is intended to come to rest on the respective support zone of the intermediate body.

As can be seen in FIG. 9, the support zone 170*a* is situated at a distance from the skirt 72*a* of the intermediate body that is approximately the same as the distance between the support zone 170*b* and the skirt 72*b*. As is also apparent from the drawings, the tabs of actuator at least partially extend through the assembly skirt to actuate the containers by way of the intermediate body, for example with the tabs extending past the walls or stops holding the intermediate body and/or with the tabs extending past other parts associated with the assembly skirt.

Thus when the actuator element is pressed down, the intermediate body is stressed in two spaced zones which are each at the same distance from each actuator rod. Thus the arrangement will better or more identically tilt each actuator rod than when a single support zone is used which is located approximately in the center of the elongated part of the intermediate body.

According to a variation not shown, two rigid tabs 53 can be located such that they come to rest on the actuator body approximately in the axis of the skirts 72*a* and 72*b*.

According to another variant, the actuator element can include more than two tabs, for example four, six or more.

Advantageously, tamper-proof pins not shown in the figures can be provided to link the actuator element 50 to the cap 80 on each side of the actuator element before first use of the device. These pins break on first activation of the actuator element.

To position the distribution device on the containers 30, the assembly collar is arranged on the adjacent recipients 30 until the assembly collar 40 engages on the collars 32 of the containers 30.

At the same time the distribution nozzle 60 and the intermediate element are assembled by sliding the mouthpiece 63 of the nozzle 60 on the outlet pipe 73 of the intermediate element. The assembly skirt 90 of the distribution nozzle is then fixed in the assembly collar 40 and then the assembly is covered by the cap 80.

To cause distribution, the user presses on the support surface 52 of the actuator element 50 in the direction of the arrow F in FIG. 4. The actuator element 50 causes the intermediate element 70 to tilt forwards, which has the effect of also tilting the rods of valve 31. As the forces are distributed evenly over the intermediate body, the two rods of valves 31 are tilted identically such that the same quantity of product can leave the inner channel of each valve rod, circulate within the intermediate element and reach the distribution nozzle to arrive at each outlet orifice. By virtue of the flexible strap 96, the distribution nozzle 60 tilts forward at the same time, with its free end moving away from the cap 80 and hence the flap. This avoids depositing product on the cap and in particular on the flap.

In the detailed description above, reference is made to preferred embodiments of the invention. It is evident that variations may be made without leaving the invention as claimed below. In particular, the intermediate element 70 and the distribution nozzle 60 can be provided without a partition, such that the two products mix before reaching the distribution orifice. The products supplied by the latter mix inside the elongated tubular part of the intermediate element as they arrive at the foot of the outlet pipe. The mixture then reaches the distribution nozzle to be distributed onto the hair for example.

In the foregoing detailed description, reference is made to preferred embodiments of the invention. It is evident that variants thereto can be proposed without departing from the invention as claimed here below. It is therefore to be understood that, within the scope of the appended claims, the invention may be practiced otherwise than as specifically described herein.

What is claimed as new and desired to be secured by Letters Patent of the United States is:

1. A distribution assembly comprising:

at least two containers each containing a product, each container being fitted with a valve comprising an actuator rod;

a distribution device mounted on top of the containers and comprising:

a distribution nozzle having at least one distribution orifice;

a movable actuator element to actuate the simultaneous distribution of two products in a mixed or separate state;

an intermediate body separate from the actuator element and comprising two skirts, wherein the two skirts engage respectively on the two actuator rods of the containers, and wherein the intermediate body further includes two channels extending respectively from the two skirts and in a direction toward each other, and wherein each of the two channels extends to an outlet pipe which is in fluid communication with the distribution nozzle;

wherein the actuator element comprises at least two rigid tabs which contact the intermediate body in at least two support zones spaced apart from each other, and wherein the outlet pipe is between the two support zones, and the two support zones are each positioned between the outlet pipe and a respective one of the two skirts;

wherein upon actuation the two rigid tabs of the actuator element contact the intermediate body at the two support zones to move the intermediate body such that the two skirts tilt the actuator rods to cause the products to pass from the containers to the distribution nozzle via the two channels and the outlet pipe.

2. An assembly according to claim 1, wherein a distance between a first of the support zones and a first of the skirts is approximately the same as a distance between a second of the support zones and a second of the skirts.

3. An assembly according to claim 1, wherein each tab comprises an inclined edge which contacts the intermediate body.

4. An assembly according to claim 1, wherein the distribution nozzle and the intermediate element are arranged such that tilting of the intermediate element causes tilting of the distribution nozzle on operation of the actuator element.

5. An assembly according to claim 1, wherein the products emerge from the outlet pipe in a separate or mixed state, and wherein the distribution nozzle comprises a mouthpiece which receives said outlet pipe.

6. An assembly according to claim 1, wherein the intermediate body is arranged to transfer the products separately to the distribution nozzle.

7. An assembly according to claim 6, wherein the distribution nozzle is arranged to transfer the products separately to a free end thereof, and wherein the free end delimits two distribution orifices.

8. An assembly according to claim 1, wherein the intermediate body is arranged to allow the mixing of the products before they reach the distribution nozzle.

9. An assembly according to claim 1, wherein the distribution nozzle is linked by a flexible strap to an assembly skirt.

10. An assembly according to claim 9, wherein the distribution device comprises an assembly collar which engages with collars formed on the containers.

11. An assembly according to claim 10, wherein the assembly skirt of the distribution nozzle is engaged with the assembly collar.

12. An assembly according to claim 1, further including a cap which protects at least a portion of the distribution nozzle.

13. An assembly according to claim 12, wherein a free end of the distribution nozzle moves away from the cap on operation of the actuator element, and wherein the distribution nozzle is moved by the intermediate body so that the free end moves away from the cap.

14. An assembly according to claim 13, wherein the cap includes a flap which can selectively close the free end of the distribution nozzle.

15. An assembly according to claim 14, wherein the flap is configured to restrict, when closed, movement of the distribution nozzle and thereby restrict movement of the actuator element and the intermediate body to prevent distribution of the products.

16. An assembly according to claim 14, wherein the flap comprises a projecting element which is insertable into the distribution nozzle so as to restrict movement of the nozzle relative to the cap.

17. An assembly according to claim 1, wherein the distribution device further includes an assembly collar, wherein the assembly collar comprises tubular skirts defining the housings intended to receive the containers.

18. An assembly according to claim 1, wherein the containers contain products to be mixed contemporaneously.

19. An assembly according to claim 1, wherein the containers are pressurized.

20. An assembly according to claim 1, wherein the containers contain cosmetic products.

21. An assembly according to claim 1, wherein the containers contain hair colorant products.

22. An assembly according to claim 1, wherein the distribution nozzle is mounted upon an assembly skirt, and wherein during dispensing a portion of the actuator element extends at least partially through the assembly skirt to contact the intermediate body.

23. An assembly according to claim 22, wherein the actuator element is coupled to a cap, and wherein the cap is positioned over at least part of the assembly skirt.

24. An assembly according to claim 23, further including means for mounting said cap on said assembly skirt.

25. An assembly according to claim 24, wherein said means for mounting includes at least one projection extending from said cap and at least one slot on said assembly skirt which receives said at least one projection.

26. An assembly according to claim 23, further including an assembly collar to which the at least two containers are coupled, and wherein at least part of the intermediate body is positioned between said assembly skirt and said assembly collar.

27. An assembly according to claim 26, wherein the intermediate body includes a tubular section within which the two channels extend wherein said tubular section is positioned between said assembly skirt and said assembly collar and wherein products from said tubular section pass through said outlet pipe toward said distribution nozzle.

28. An assembly according to claim 1, further including an assembly collar to which said containers are coupled, wherein said actuator rods extend through respective openings of said assembly collar to engage the intermediate body.

29. A distribution assembly comprising:

a first container containing a first product, said first container including a first valve;

a second container containing a second product, said second container including a second valve;

a cap which includes an actuator element;

an assembly skirt at least partially positioned under said cap and above said first and second containers, wherein said assembly skirt includes at least one wall and a distribution nozzle movably coupled to the assembly skirt with a movable coupling such that the distribution nozzle is movable relative to the at least one wall, the distribution nozzle including at least one outlet through which the products exit and a mouthpiece through which the products enter the distribution nozzle; and an intermediate body which includes first and second skirts which respectively receive said first product and said second product from said first valve and said second valve, said intermediate body including at least one tubular section which receives the first and second products from the first and second skirts, the intermediate body further including at least one outlet pipe coupled to the mouthpiece of the distribution nozzle, wherein said first and second products pass from said tubular section through said at least one outlet pipe toward said distribution nozzle;

wherein a portion of said actuator element includes first and second tabs extending through at least part of said assembly skirt to contact and move the intermediate body at first and second locations spaced from said outlet pipe upon application of a force to the actuator element and thereby cause said first and second products to flow through said intermediate body and to said distribution nozzle, and wherein movement of the intermediate body upon application of a force to the actuator element causes movement of the outlet pipe which thereby moves the mouthpiece of the distribution nozzle coupled to the outlet pipe, and wherein movement of the mouthpiece resulting from coupling of the mouthpiece to the outlet pipe is accommodated by the movable coupling of the distribution nozzle to the assembly skirt.

30. An assembly according to claim 29, further including an assembly collar, wherein said first and second containers are coupled to said assembly collar, and wherein the assembly skirt is mounted to said assembly collar with said intermediate body at least partially between said assembly skirt and said assembly collar.

31. An assembly according to claim 30, wherein said first and second valves are arranged to be actuated by a tilting of first and second actuator rods respectively associated with said first and second valves, and wherein said actuator element causes said intermediate body to tilt and thereby causes tilting of said first and second actuator rods and tilting of the outlet pipe of the intermediate body, and wherein tilting of the outlet pipe causes movement of the mouthpiece and movement of the outlet of the distribution nozzle.

32. An assembly according to claim 31, wherein said assembly collar includes first and second apertures, and wherein said first and second actuator rods respectively extend through said first and second apertures to engage said first and second skirts of said intermediate body.

33. An assembly according to claim 30, wherein said assembly collar includes a peripheral wall, wherein at least part of said assembly skirt is positioned inside of said peripheral wall, and wherein a portion of said cap extends outside and around at least part of said peripheral wall.

34. A distribution assembly comprising:

first and second containers having respective first and second actuator rods;

a first part in the form of an assembly collar which receives and holds the first and second containers;

a second part in the form of an intermediate body which is positioned on the assembly collar, said intermediate body including an outlet pipe and further including first and second skirts which engage the first and second actuator rods, and wherein upon actuation of the first and second actuator rods, products from the first and second containers pass through the intermediate body to the outlet pipe;

a third part in the form of an assembly skirt which extends over the intermediate body such that the intermediate body is at least partially positioned between the first part and the third part, wherein the first and third parts include coupling arrangements to couple the first and third parts together with the intermediate body therebetween, and wherein the assembly skirt includes a distribution nozzle, and said distribution nozzle includes a mouthpiece in fluid communication with the outlet pipe, said distribution nozzle further including at least one outlet through which the products of the first and second containers exit the distribution assembly;

a fourth piece comprising an actuator element having an actuator surface disposed above at least a portion of the assembly skirt, and wherein a portion of the actuator element extends through the assembly skirt to engage and move the intermediate body upon application of a force to the actuator surface and thereby cause the intermediate body to actuate the first and second actuator rods by way of the first and second skirts, and wherein the actuator element engages the intermediate body at least one location spaced from the outlet pipe and located between the outlet pipe and one of the first and second skirts.

35. An assembly according to claim 34, wherein the fourth piece is in the form of a cap, said cap including a closure flap which closes and restricts movement of the at least one outlet of the distribution nozzle in a closed position;

wherein in an open position of the closure flap, actuation of the actuator element causes movement of the intermediate body and movement of the intermediate body causes movement of the outlet pipe and thereby causes movement of the outlet of the distribution nozzle by way of engagement between the outlet pipe of the intermediate body and the mouthpiece of the distribution nozzle; and wherein in the closed position of the closure flap, the closure flap restricts movement of the at least one outlet and thereby restricts movement of the intermediate body due to the engagement of the mouthpiece and the outlet pipe such that actuation of the first and second actuator rods is prevented.

36. A distribution assembly comprising:

at least two containers each containing a product, each container being fitted with a valve comprising an actuator rod;

a distribution device mounted on top of the containers and comprising:

a distribution nozzle having at least one distribution orifice;

a movable actuator element to actuate the simultaneous distribution of two products in a mixed or separate state;

an intermediate body separate from the actuator element and comprising two skirts, wherein the two skirts engage respectively on the two actuator rods of the containers, and wherein the intermediate body further includes two channels extending respectively from the two skirts and in a direction toward each other;

wherein each of the two channels extends to an outlet pipe which is in fluid communication with the distribution nozzle;

wherein upon actuation the actuator element causes the intermediate body to move such that the two skirts tilt the actuator rods to cause the products to pass from the containers to the distribution nozzle via the two channels and the outlet pipe;

wherein the distribution nozzle is connected to the intermediate body such that the distribution nozzle is moved by the intermediate body when the intermediate body is moved to cause the products to pass from the containers; and wherein the assembly further includes a flap which is movable between an open position and a closed position, and wherein in the closed position the flap engages with the distribution nozzle and restricts movement of the distribution nozzle and thereby restricts movement of the actuator element and the intermediate body to prevent distribution of the products.

37. An assembly according to claim 36, wherein the assembly includes a cap, and wherein the actuator element is connected to the cap by a film hinge, and further wherein the flap is connected to the cap by a film hinge.

38. A distribution assembly comprising:

a first container containing a first product, said first container including a first valve;

a second container containing a second product, said second container including a second valve;

a cap which includes an actuator element;

an assembly skirt at least partially positioned under said cap and above said first and second containers, wherein said assembly skirt includes at least one wall and a distribution nozzle movably coupled to the assembly skirt by a flexible strap such that the distribution nozzle is movable relative to the at least one wall by way of the flexible strap, the distribution nozzle including at least one outlet through which the products exit and a mouthpiece through which the products enter the distribution nozzle; and an intermediate body which includes first and second skirts which respectively receive said first product and said second product from said first valve and said second valve, said intermediate body including at least one tubular section which receives the first and second products from the first and second skirts, the intermediate body further including at least one outlet pipe coupled to the mouthpiece of the distribution nozzle, wherein said first and second products pass from said tubular section through said at least one outlet pipe toward said distribution nozzle;

wherein a portion of said actuator element extends through at least part of said assembly skirt to move the intermediate body upon application of a force to the actuator element and thereby cause said first and second products to flow through said intermediate body and to said distribution nozzle, and wherein movement of the intermediate body upon application of a force to the actuator element causes movement of the outlet pipe which thereby moves the mouthpiece of the distribution nozzle coupled to the outlet pipe, and wherein movement of the mouthpiece resulting from coupling of the mouthpiece to the outlet pipe is accommodated by said flexible strap which movably couples the distribution nozzle to the assembly skirt.

39. A distribution assembly as recited in claim 38, further including at least one tab or pin provided on the assembly skirt to prevent wobbling of the distribution nozzle during assembly.

40. A distribution assembly comprising:

a first container containing a first product, said first container including a first valve;

a second container containing a second product, said second container including a second valve;

a cap which includes an actuator element;

an assembly skirt at least partially positioned under said cap and above said first and second containers, wherein said assembly skirt includes at least one wall and a distribution nozzle movably coupled to the assembly skirt by a movable coupling such that the distribution nozzle is movable relative to the at least one wall, the distribution nozzle including at least one outlet through which the products exit and a mouthpiece through which the products enter the distribution nozzle; and an intermediate body which includes first and second skirts which respectively receive said first product and said second product from said first valve and said second valve, said intermediate body including at least one tubular section which receives the first and second products from the first and second skirts, the intermediate body further including at least one outlet pipe coupled to the mouthpiece of the distribution nozzle, wherein said first and second products pass from said tubular section through said at least one outlet pipe toward said distribution nozzle;

wherein a portion of said actuator element extends through at least part of said assembly skirt to move the intermediate body upon application of a force to the actuator element and thereby cause said first and second products to flow through said intermediate body and to said distribution nozzle, and wherein movement of the intermediate body upon application of a force to the actuator element causes movement of the outlet pipe which thereby moves the mouthpiece of the distribution nozzle coupled to the outlet pipe, and wherein movement of the mouthpiece resulting from coupling of the mouthpiece to the outlet pipe is accommodated by said movable coupling which couples the distribution nozzle to the assembly skirt; and means for preventing wobbling of the distribution nozzle during assembly, said means for preventing wobbling including at least one tab or pin provided on the assembly skirt to prevent wobbling of the distribution nozzle during assembly.

* * * * *